United States Patent [19]

Demers

[11] Patent Number: 4,742,663

[45] Date of Patent: May 10, 1988

[54] CONCEALED LOAD DISTRIBUTION MEANS FOR WOODEN BEAMS

[75] Inventor: Harlan J. Demers, Orrville, Ohio

[73] Assignee: Koppers Company, Inc., Pittsburgh, Pa.

[21] Appl. No.: 261,593

[22] Filed: May 7, 1981

Related U.S. Application Data

[60] Continuation-in-part of Ser. No. 102,634, Dec. 11, 1979, abandoned, which is a division of Ser. No. 883,321, Mar. 3, 1978, abandoned.

[51] Int. Cl.[4] ..... E04C 3/30; F16B 35/04

[52] U.S. Cl. ..... 52/726; 403/296; 411/387; 411/389

[58] Field of Search ..... 52/726, 698, 721, 698, 52/704, 787, 705, 711, 707; 403/296, 343, 267; 411/387, 389, 388, 386, 166, 177, 187, 188

[56] References Cited

U.S. PATENT DOCUMENTS

| | | | |
|---|---|---|---|
| 1,045,562 | 11/1912 | Kennedy | 52/711 |
| 1,264,189 | 4/1918 | Keator | 52/704 |
| 1,428,247 | 9/1922 | Morris . | |
| 3,305,996 | 2/1967 | Shapiro | 52/787 |
| 3,312,139 | 4/1967 | Di Cristina | 52/726 X |
| 3,605,360 | 9/1971 | Lindal | 52/730 X |
| 3,621,557 | 11/1971 | Cushman et al. | 411/176 X |
| 3,709,733 | 1/1973 | Mautner | 52/787 X |
| 3,742,675 | 7/1973 | Demers | 52/698 |
| 3,986,429 | 10/1976 | Busler | 403/296 |
| 4,097,162 | 6/1978 | Lindal | 52/730 X |
| 4,125,050 | 11/1978 | Schwartzman et al. | 411/387 |

FOREIGN PATENT DOCUMENTS

| | | | |
|---|---|---|---|
| 4341 | 2/1894 | United Kingdom | 411/386 |

*Primary Examiner*—Carl D. Friedman
*Assistant Examiner*—Michael Safavi
*Attorney, Agent, or Firm*—Donald M. MacKay; Herbert J. Zeh, Jr.

[57] ABSTRACT

Wooden beams containing concealed load distribution means embedded therein are disclosed herein. The wooden beams may be either laminated or unitary. The load distribution means is comprised of an elongated member suitably adapted such that loads exerted on the elongated member are therefrom transmitted to and more evenly distributed within the wooden beam.

2 Claims, 1 Drawing Sheet

CONCEALED LOAD DISTRIBUTION MEANS FOR WOODEN BEAMS

CROSS REFERENCE TO RELATED APPLICATIONS

This is a continuation-in-part application of Ser. No. 102,634 filed Dec. 11, 1979 (now abandoned) which in turn is a divisional application of Ser. No. 883,321 filed Mar. 3, 1978 (now abandoned).

BACKGROUND OF THE INVENTION

The present invention relates to the attachment of and load distribution within wooden beam elements. More particularly, the invention relates to wooden beams with a concealed element(s) in communication with a load source whereby the concealed element(s) distribute loads more evenly within a wooden beam.

Wood elements are gaining increased architectural uses, not only as structural elements, but also to create aesthetically pleasing environments. Therefore, many architectural designs require that wooden beams (hereinafter simply referred to as beams) be displayed in an aesthetically pleasing manner while performing their structural assignments. The structural assignment of a beam will require the beam to withstand certain load conditions. In general, the greater the load acting on the beam, the larger the beam required to withstand the load. However, large structural beams may be architecturally inhibiting and aesthetically undesirable. Additionally, the most aesthetically desirable type of beam may not exhibit sufficient strength under certain load conditions to allow its employment in a structure.

Generally, loads are transmitted to a beam through the means chosen to fasten the beam to a structure. Conventional fasteners such as nails, screws, bolts, and the like, which are lodged in or affixed to a beam when exposed to certain load conditions, may subject the beam to high localized loads in the beam area proximately surrounding the fastener. The load condition is similar to that created when a beam is point loaded. Therefore, the ability of a beam to withstand localized loads can be a critical design constraint.

Brackets and braces of various configurations have been utilized to decrease the severity of localized loads to which a beam element may be exposed. The employment of brackets and braces also offers the beam a certain degree of reinforcement. Brackets and braces, however, in addition to conventional fasteners, are exteriorly accessible and unattractive in appearance, thereby detracting from the natural beauty of the wood.

The present invention allows the uncompromised natural beauty of the wood to be exhibited. The invention minimizes the problems associated with excessive localized loads within a beam and acts as a concealed reinforcing agent under most load conditions. The attributes of the present invention enables the prefabrication of irregularly shaped laminated wood beams with greater emphasis toward aesthetic appeal, rather than inherent material strength.

BRIEF DESCRIPTIONS OF THE DRAWINGS

SUMMARY OF THE INVENTION

A beam containing a concealed load distribution means embedded therein is provided. The beam may be either laminated or unitary. The load distribution means consists of an elongated member suitably adapted to transmit load acting on the elongated member of a beam. The loads may be exerted on the load distribution means directly or through the beam anchoring means when the load distribution means is suitably attached to the anchoring means.

The load distribution means may also function as an anchoring means as an extension of the elongated member. In addition, two beams may be attached to each other utilizing the load distribution means as a means of attachment.

DETAILED DESCRIPTION OF THE PREFERRED EMBODIMENTS

Beams normally arrive at a work site precut in standard sizes, where, upon arrival, the beams are recut to structural design specification for deployment in a structure. The invention herein described is primarily concerned with the distribution of loads which are present at the beam structural attachment points. The invention provides a beam with increased ability to withstand loads (moments, shear and tensile - compression and tension) present at the beam attachment point. The increased ability of the beam to withstand loads is derived by embedding a element(s) wthin the beam of superior strength relative to the strength of the beam. The element(s) or load distribution means is so oriented and positioned within the beam as to receive and/or transmit loads over a beam area such that the stress buildup in the beam are well within the beam's capacity. The material composition of the load distribution means is a matter of choice to be based on the anticipated load condition and severity.

Figure 1:
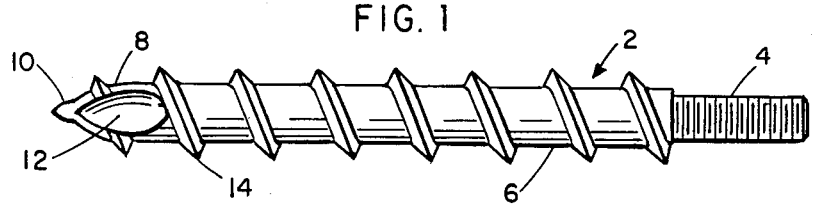
FIG. 1 is a side view of a first alternative concealed anchoring and load distribution means.

FIG. 1 shows a first load distribution means comprised of an elongated member, which is rod 2. Rod 2 has two segments 4 and 6. Rod segment 6 has a tapered surface 8 at one end. Fixably mounted to the tapered surface 8 by conventional means, such as welding, is a generally spherical member 10 (which is flat in cross section); the radius of the spherical member 10 is smaller than that of rod 2. In the tapered surface 8 region of rod segment 6 in close proximity to member 10 is a cavity 12. The rod segment 6 carries self-threading tensile elements 14 throughout the length of segment 6. The rod segment 4 is threaded. The rod 2 can be used with either laminated or unitary beams.

Figure 2:
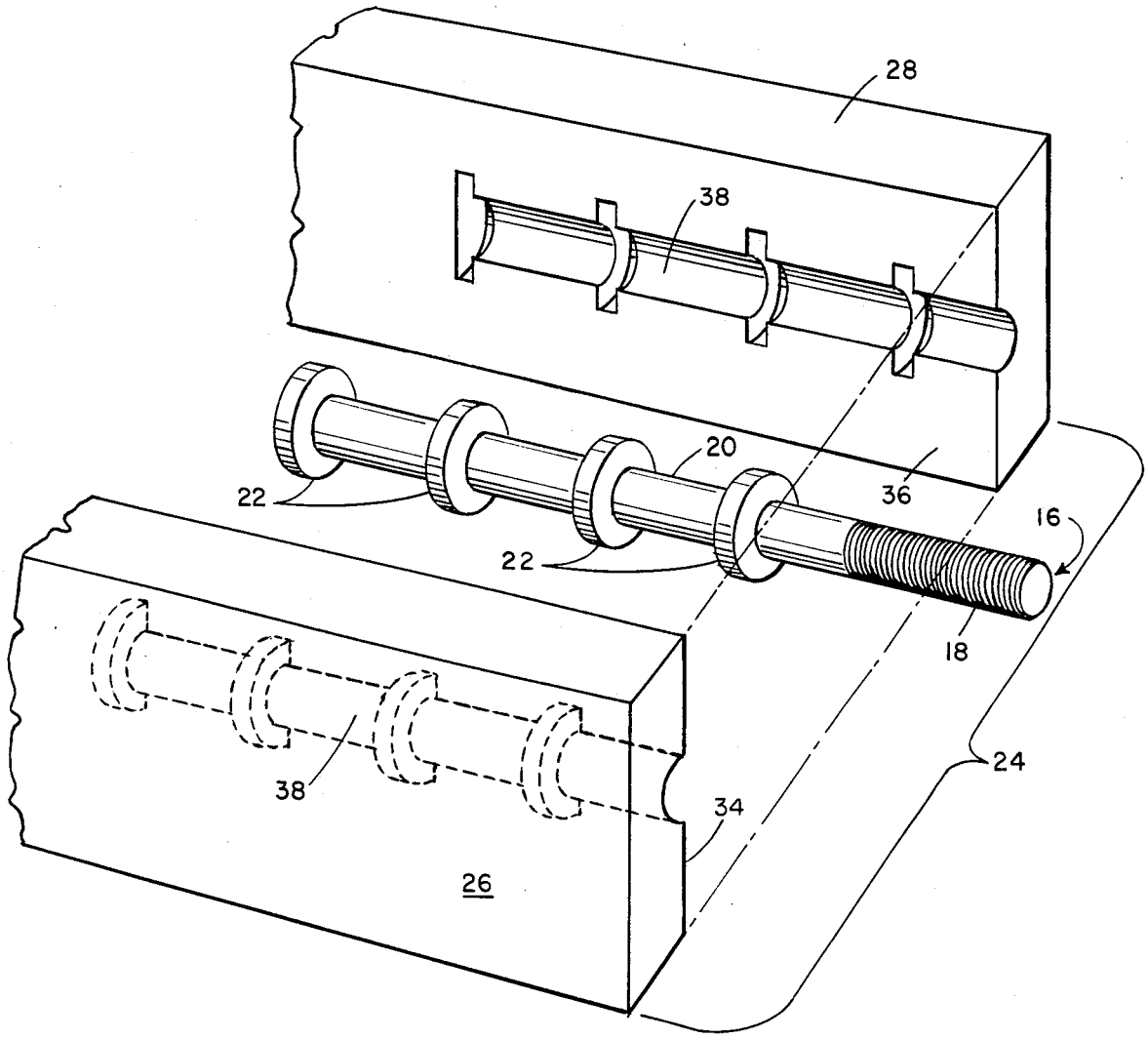
FIG. 2 is an exploded view of a laminated beam with a second alternative concealed anchoring and load distribution means specifically adapted for laminated beams.

FIG. 2 shows a second alternative embodiment of the present invention practically suited for employment in laminated beams. The load distribution means is comprised of an elongated member which is rod 16. The rod 16 has a threaded segment 18. A plurality of generally circular discs 22 are fixably mounted by conventional means, such as welding, axially along and extending radially from rod 16. Rod 16 with accompanying disc 22 can be formed by any other appropriate process, for example, the up-setting process. Rod segment 18 is threaded to facilitate the attachment of the laminated beam, generally indicated as 24, to other strutures, not shown. The laminated beam 24 is comprised of two beam members 26 and 28. Beam members 26 and 28 have mating surfaces in a contigous relationship to each other. Each mating surface 34 and 36 has a route 38, which is a negative recess concave in shape. The recess is sized like a mold cavity to cooperatively receive and closely fit the rod segment 18 and affixed discs 22 upon lamination of beam members 26 and 28. The rod segment 18 and affixed discs 22 are placed in the recess 38. The beam elements 26 and 28 are then laminated together.

Figure 3:
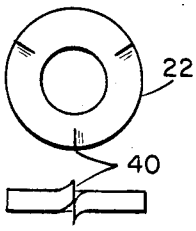
FIG. 3 is a top and end view of a prefered embodiment in which disc 22 is deformed by mechanical means to form anti-rotational surfaces 40 protruding from the top and bottom surfaces.

FIG. 3 depicts an anti-rotational device in which the disc 22 is crimped to provide a protruding surface 40.

Figure 4:
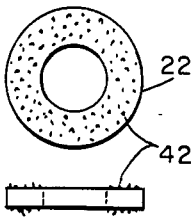
FIG. 4 is a top and end view of a preferred embodiment in which disc 22 is coated with abrasive particles 42 to form anti-rotational surfaces protruding from the top and bottom surfaces of the disc. Said particles are also alternatively or preferrably also applied to the rod shaft.

FIG. 4 shows an anti-rotational disc 22 coated with abrasive particles such as sand coated with a suitable adhesive such as epoxies.

Figure 5:
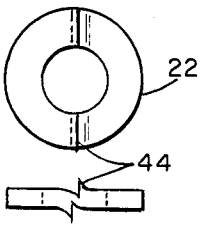
FIG. 5 is a top and end view of a preferred embodiment in which disc 22 is deformed by an alternative means to form anti-rotational surfaces 44 protruding from the top and bottom surfaces.

FIG. 5 illustrates an anti-rotational device in which edges 44 are formed by rolling the metal on both sides so that it is gouged out and folded over.

The aforedescribed elongated element which has anchoring means, i.e., that portion of the elongated element which is threaded to facilitate the attachment of the beam to other structures (rod segment 18), need not employ conventional fasteners. However, the elongated elements can be used in conjunction with conventional fasteners and/or conventional load distribution means, provided the elongated element is suitably attached to the conventional elements. Those skilled in the art will know the proper method of attachment which depends on the predicted loads and structure configuration, such that the loads are properly distributed within a beam by the elongated element.

What is claimed is:

1. A wooden laminated beam, which comprises:

A. a laminated beam including at least two beam members laminated together, each beam member having a mating surface in a mating relationship to each other;

B. load distribution means for distributing loads exerted on said load distribution means more uniformly over said laminated beam mating surface which coacts with said load distribution means under a given load condition, said load distribution means embedded within said laminated beam between said mating surfaces such that said load distribution means cannot be withdrawn from said laminated beam said load distribution means comprising a generally circular sphere and an elongated member including:

(i) self-threading tensile elements extending throughout said elongated member;

(ii) a tapered cutting surface at one end of said elongated member;

(iii) an excavation in the region of said tapered cutting surface wherein said sphere being fixably mounted to said tapered cutting surface in close proximity to said excavation, said sphere having a radius smaller than said elongated member.

2. The beam of claim 1 wherein the excavation extends to a first thread of said tapered cutting surface.

* * * * *